US006543092B2

(12) United States Patent
Breuer

(10) Patent No.: US 6,543,092 B2
(45) Date of Patent: Apr. 8, 2003

(54) METHOD OF DETERMINING SETTING VALUES FOR A PRELIMINARY DRAFT IN A REGULATED DRAW FRAME

(75) Inventor: Achim Breuer, Aachen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/158,125

(22) Filed: May 31, 2002

(65) Prior Publication Data

US 2002/0152587 A1 Oct. 24, 2002

Related U.S. Application Data

(63) Continuation-in-part of application No. 10/076,138, filed on Feb. 15, 2002, now abandoned.

(30) Foreign Application Priority Data

Feb. 16, 2001 (DE) ..... 101 07 281
Dec. 19, 2001 (DE) ..... 101 62 312

(51) Int. Cl.[7] ..... D01H 5/00
(52) U.S. Cl. ..... 19/236; 19/239
(58) Field of Search ..... 19/236, 237, 238, 19/239, 240, 98, 105, 150, 157, 300; 57/412; 700/130, 142; 702/170

(56) References Cited

U.S. PATENT DOCUMENTS 4,653,153 A * 3/1987 Felix et al. ..... 19/240
4,812,993 A * 3/1989 Konig et al. ..... 700/142
4,819,301 A * 4/1989 Konig et al. ..... 19/240
4,864,694 A * 9/1989 Konig et al. ..... 19/240
5,461,757 A 10/1995 Leifeld
5,583,781 A * 12/1996 Denz et al. ..... 700/130
5,771,542 A * 6/1998 Dammig ..... 19/239
5,815,890 A 10/1998 Leifeld
6,088,882 A * 7/2000 Leifeld ..... 19/239
6,151,760 A * 11/2000 Weber ..... 19/157
6,266,573 B1 * 7/2001 Promoli ..... 700/142

FOREIGN PATENT DOCUMENTS

DE 44 04 326 10/1994
DE 195 37 983 4/1997
DE 199 09 040 10/1999

OTHER PUBLICATIONS

Porsche, "Neuere Strecksysteme auf der Baumwollstrecke" TEXTIL–PRAXIS Jun. 1957 p. 523.

* cited by examiner

*Primary Examiner*—Gary L. Welch
(74) *Attorney, Agent, or Firm*—Venable, LLP; Robert Kinberg

(57) ABSTRACT

A method of determining an optimal preliminary draft of sliver running consecutively through a preliminary drafting field and a principal drafting field. The method includes the following steps: setting various levels for the preliminary draft; measuring quality-characterizing magnitudes of the sliver drafted at the various preliminary draft levels; deriving sliver number deviations from the quality-characterizing magnitudes; determining a function between the sliver number deviations and the respective preliminary draft levels; forming two approximated straight lines from the function; determining a value of a point of intersection between the two straight lines; and utilizing the value of the point of intersection for setting the optimal preliminary draft.

8 Claims, 1 Drawing Sheet

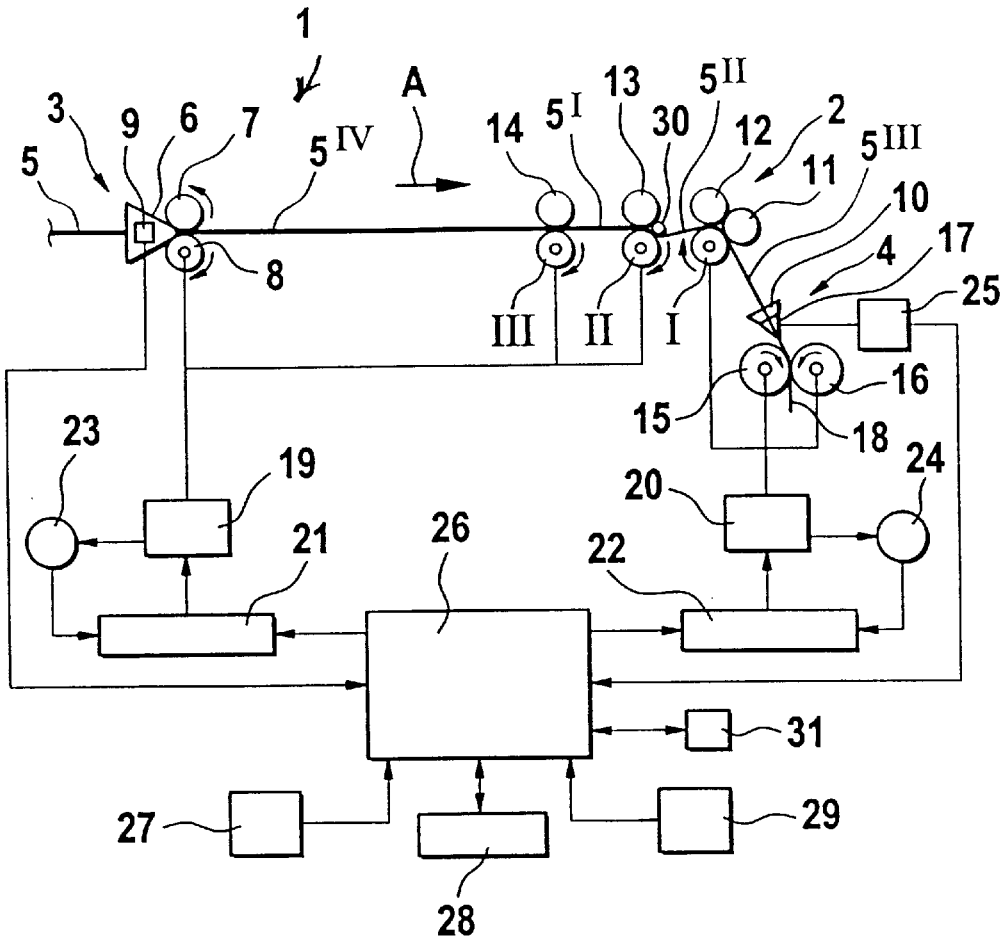
Fig. 1
Fig. 2
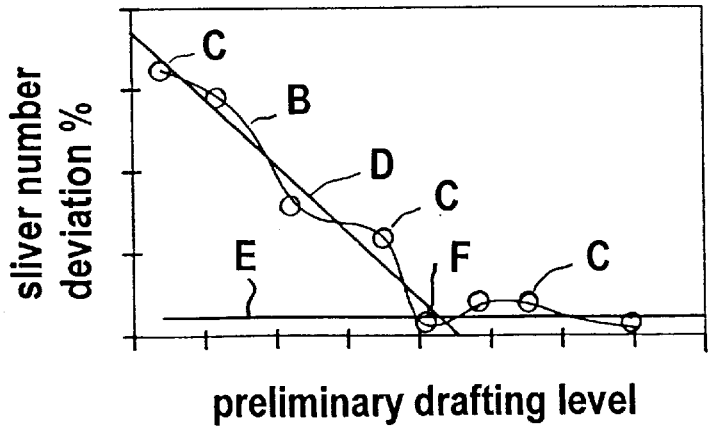

METHOD OF DETERMINING SETTING VALUES FOR A PRELIMINARY DRAFT IN A REGULATED DRAW FRAME

CROSS REFERENCE TO RELATED APPLICATIONS

This application is a continuation-in-part of application Ser. No. 10/076,138 filed Feb. 15, 2002 now abandoned.

This application claims the priority of German Application Nos. 101 07 281.3 filed Feb. 16, 2001 and 101 62 312.7 filed Dec. 19, 2001, which are incorporated herein by reference.

BACKGROUND OF THE INVENTION

This invention relates to a method of determining the setting values for the preliminary drafting field in a regulated draw frame. The ratio of the circumferential velocities of the mid rolls to the input rolls of the draw unit is variable. Measured values of a quality-characterizing property (such as thickness variations) of the drafted sliver are obtained, from which sliver number deviations may be derived.

The setting of the preliminary draft in a draw unit is effected by means of two preliminary draft-setting wheels. In practice, the optimal preliminary drafting level is set dependent on multilayer yarn characteristics. The level (extent) of the preliminary drafting has a substantial significance as concerns the yarn and sliver and also, as concerns the efficiency of the spinning machines. During the setting processes at the draw unit, various preliminary drafting levels are tested and dependent on the optimizing objective, that is, a good yarn CV or a great strength, corresponding settings are chosen. Accordingly, appropriate setting wheels are selected. It is a disadvantage of such an arrangement that the setting requires a great extent of skill and experience and further, an online determination is not possible.

SUMMARY OF THE INVENTION

It is an object of the invention to provide an improved method of the above-outlined type from which the discussed disadvantages are eliminated and which, in particular, makes possible an online determination of the optimal preliminary draft and the making of an improved fiber structure such as a sliver or yarn.

This object and others to become apparent as the specification progresses, are accomplished by the invention, according to which, briefly stated, the method includes the following steps: setting various levels for the preliminary draft; measuring quality-characterizing magnitudes of the sliver drafted at the various preliminary draft levels; deriving sliver number deviations from the quality-characterizing magnitudes; determining a function between the sliver number deviations and the respective preliminary draft levels; forming two approximated straight lines from the function; determining a value of a point of intersection between the two straight lines; and utilizing the value of the point of intersection for setting the optimal preliminary draft.

By means of the measures according to the invention, an online determination of the optimal preliminary draft may be obtained, whereby an optimal setting is feasible even in case of a change in the fiber assortment. In this manner, preliminary drafting values are determined for the most important fiber materials. Further, the invention may also be utilized for a self-optimization of the setting of the draw frame.

BRIEF DESCRIPTION OF THE DRAWINGS

FIG. 1 is a schematic side elevational view of a regulated draw frame incorporating the invention.

FIG. 2 is a diagram illustrating a sliver number deviation (ordinate) as a function of the preliminary drafting level (abscissa).

DESCRIPTION OF THE PREFERRED EMBODIMENT

FIG. 1 shows a draw frame 1 which may be, for example, an HSR model manufactured by Trützschler GmbH & Co. KG, Mönchengladbach, Germany. The draw frame 1 includes a draw unit 2 having an upstream-arranged draw unit inlet 3 and a downstream-arranged draw unit outlet 4. The slivers 5 are introduced from non-illustrated coiler cans into a sliver guide 6 and, pulled by delivery rolls 7 and 8, moved through a measuring member 9. The draw unit 2 is a 4-over-3 construction, that is, it has a lower output roll I, a lower mid roll II and a lower input roll III as well as four upper rolls 11, 12, 13 and 14. The sliver length portion between the roll pair III, 14 and the roll pair 7, 8 is designated at $\mathbf{5}^{IV}$. The region between the roll pair III, 14 and II, 13 constitutes a preliminary drafting field in which the sliver portion $\mathbf{5}^{I}$ is drafted. The region extending between the roll pair II, 13 and the roll assembly I, 11 and 12 constitutes the principal drafting field where the sliver length portion $\mathbf{5}^{II}$ is drafted. A sliver pressing bar 30 is arranged immediately downstream of the roll pair II, 13. The drafted slivers discharged by the roll assembly I, 11 and 12 are designated at $\mathbf{5}^{III}$ and are introduced at the draw unit outlet 4 into a sliver guide 10. Delivery rolls 15, 16 pull the slivers through a sliver trumpet 17 in which they are combined into a single sliver 18 which is subsequently deposited in a non-illustrated coiler can. The fiber processing direction through the draw frame 1 is designated at A.

The delivery rolls 7, 8, the lower input roll III and the lower mid roll II which are mechanically connected to one another, for example, by means of a toothed belt, are driven by a regulating motor 19 dependent upon an inputted nominal value. The respective upper rolls 14 and 13 are driven by friction from the lower rolls they are associated with. The lower output roll I and the delivery rolls 15, 16 are driven by a main motor 20. The regulating motor 19 and the main motor 20 are connected with a respective regulator 21, 22. The rpm regulation is performed by a closed regulating circuit which contains a tachogenerator 23 associated with the regulating motor 19 and a tachogenerator 24 associated with the main motor 20. At the draw unit inlet 3 a mass-proportionate magnitude, for example, the cross section (thickness) of the slivers 5 is measured by means of a measuring member 9 of the type described in German patent document 44 04 326 to which corresponds U.S. Pat. No. 5,461,757. At the draw unit outlet 4 the cross section (thickness) of the exiting sliver 18 is measured by a measuring member 25 integrated in the sliver trumpet 17. Such a sensor is described, for example, in German patent document 195 37 983. A central computer unit 26 (control and regulating device), for example a microcomputer having a microprocessor, applies a nominal rpm setting to the regulator 21 for the regulating motor 19. The measured values obtained from the two measuring members 9 and 25 are applied to the central computer unit 26 during the drafting process. The nominal rpm for the regulating motor 19 is determined in the central computer unit 26 from the measured values of the intake measuring member 9 and from the nominal value for the cross section of the exiting sliver 18. The measured values obtained from the outlet measuring member 25 serve for monitoring the exiting sliver 18 and for the online determination of the optimal preliminary draft. With this regulating system fluctuations in the cross section of the inputted sliver 5 may be compensated for by regulating the drafting process to thus obtain an evening of the sliver. A monitor screen 27, an interface 28, an inputting device 29 and a memory 31 are connected to the central computer unit 26.

The measured values obtained from the measuring member 25, for example, the thickness fluctuations of the sliver 18 are applied to the memory 31. The device according to the invention makes possible a direct determination of setting values for the preliminary draft. The measuring member 25 determines a plurality of thickness values from the sliver portion $\mathbf{5}^{III}$ discharged by the roll assembly I, 11, 12. Such measurements are performed over various sliver lengths, based on which the sliver number deviations are computed in the control and regulating device 26.

Also referring to FIG. 2, the function (relationship) between the measured values of the sliver number deviations and the preliminary drafting values are subsequently determined by computation by the control and regulating device 26 or graphically, or by a table. The measured values are reproduced graphically or by computation as two approximated straight lines, and the automatically computed point of intersection of the two straight lines is utilized for setting an optimal preliminary draft. The optimal preliminary draft lies by a constant factor next to the point of intersection. Thus, as shown in FIG. 2, a curve B is generated from a plurality of measured values C. From curve B, in turn, two approximated straight lines D and E are formed, whose point of intersection F yields a characterizing value for the setting of the optimal preliminary draft.

Thus, by means of the apparatus according to the invention the optimal preliminary drafting level is determined and set in the draw frame. By virtue of the fact that the optimal preliminary drafting level may be determined online and to such a preliminary drafting level a characterizing value may be assigned, the curling of the drafted sliver may be realistically described for the drafting process. These measures constitute an important step toward a self-optimizing draw frame. It is the purpose of the preliminary drafting to remove the curling from the fibers. An optimal preliminary drafting level exists in which the curling may be just taken out of the fibers; below and above such an optimal drafting level the quality deteriorates.

If curled fibers run from the preliminary drafting field into the principal drafting field of the draw frame, then a level for the drafting force in the principal drafting field is obtained which is different from that level which would be obtained if fully drafted (fully uncurled) fibers ran from the preliminary drafting field into the principal drafting field. Such a drafting force change may be detected with the sensor 25 integrated in the trumpet 17, so that with that sensor the optimal preliminary drafting level may be determined.

It will be understood that the above description of the present invention is susceptible to various modifications, changes and adaptations, and the same are intended to be comprehended within the meaning and range of equivalents of the appended claims.

What is claimed is:

1. A method of determining an optimal preliminary draft of sliver running consecutively through a preliminary drafting field and a principal drafting field, comprising the following steps:

(a) setting various preliminary draft levels;

(b) measuring quality-characterizing magnitudes of the sliver drafted at the various preliminary draft levels;

(c) deriving sliver number deviations from said quality-characterizing magnitudes;

(d) determining a function between the sliver number deviations and respective said preliminary draft levels;

(e) approximating two straight lines from said function;

(f) determining a value of a point of intersection between the two straight lines; and (g) utilizing said value of said point of intersection for setting the optimal preliminary draft.

2. The method as defined in claim 1, wherein said quality-characterizing magnitude is the thickness of the drafted sliver.

3. The method as defined in claim 2, wherein step (c) is performed online.

4. The method as defined in claim 1, wherein step (d) is performed by computation.

5. The method as defined in claim 1, wherein step (d) is performed based on a table.

6. The method as defined in claim 1, wherein step (d) is performed graphically.

7. The method as defined in claim 1, wherein step (e) is performed by computation.

8. The method as defined in claim 1, wherein step (f) is performed by computation.

* * * * *